US008085123B2

(12) United States Patent
Borchardt et al.

(10) Patent No.: US 8,085,123 B2
(45) Date of Patent: Dec. 27, 2011

(54) WEAR INDICATOR FOR A CIRCUIT INTERRUPTER EXHAUST CONTROL DEVICE

(75) Inventors: Glenn R. Borchardt, Round Lake Beach, IL (US); Michael G. Ennis, Evanston, IL (US); Jorge R. Montante, Cicero, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 12/950,314

(22) Filed: Nov. 19, 2010

(65) Prior Publication Data

US 2011/0063069 A1 Mar. 17, 2011

Related U.S. Application Data

(62) Division of application No. 12/044,010, filed on Mar. 7, 2008, now Pat. No. 7,864,022.

(60) Provisional application No. 60/894,031, filed on Mar. 9, 2007.

(51) Int. Cl.
*H01H 85/38* (2006.01)
*H01H 33/02* (2006.01)

(52) U.S. Cl. ..... 337/250; 337/249; 337/273; 337/272; 337/281; 218/157

(58) Field of Classification Search ..... 337/273, 337/249, 250, 272, 281; 218/157
See application file for complete search history.

(56) References Cited

U.S. PATENT DOCUMENTS 4,206,308 A * 6/1980 Murakami et al. ..... 546/347
4,339,207 A * 7/1982 Hof et al. ..... 374/16
4,464,064 A * 8/1984 D'Luzansky ..... 374/101
4,538,926 A * 9/1985 Chretien ..... 374/150
5,738,442 A * 4/1998 Paron et al. ..... 374/162

* cited by examiner

*Primary Examiner* — Anatoly Vortman

(57) ABSTRACT

An exhaust control device includes a wear indicator disposed within a housing of the exhaust control device. The wear indicator is arranged to be exposed to a flow of exhaust gas through the exhaust control device. The wear indicator has a first observable state indicative of remaining useful life of the exhaust control device. The wear indicator is responsive to a flow of exhaust gas through the exhaust control device to assume a second observable state indicative of the exhaust control device having reached the end of its useful life.

5 Claims, 5 Drawing Sheets

WEAR INDICATOR FOR A CIRCUIT INTERRUPTER EXHAUST CONTROL DEVICE

TECHNICAL FIELD

This patent is a division of U.S. patent application Ser. No. 12/044,010 filed Mar. 7, 2008 entitled Wear Indicator for a Circuit Interrupter Exhaust Control Device, which patent claims benefit under 35 U.S.C. §119(e) to U.S. Provisional Application Ser. No. 60/894,031, filed Mar. 9, 2007, the disclosures of which are hereby expressly incorporated herein for all purposes.

This patent relates to circuit interrupting devices, and in particular, this patent relates to a wear indicator for an exhaust gas silencer associated with a circuit interrupting device.

BACKGROUND

Certain types of circuit-interrupting devices, such as fuses, discharge hot arc products and gases during fault isolation. The exhaust gases are not typically discharged from the device directly into the atmosphere, but they are instead guided through an exhaust control device. The exhaust control device may include heat absorbing and arc suppressing material to reduce the temperature and energy of the discharged arc products and may further provide sound suppression.

Exhaust control devices are capable of both reducing the sound level and the gas discharge without significantly interfering with the intended circuit-interrupting function of the fuse or device. Further, these devices, unlike non-vented devices, do not create unsuitably high back pressures to the circuit-interrupting device which might cause undesirable effects, including higher pressures and operating temperatures, longer arcing time, and higher operating energies that must be dissipated. It is also desirable that the exhaust control device be as small and light-weight as possible, while retaining efficiency of operation and being capable of functioning repeatedly without loss of effectiveness. An exemplary exhaust control device is disclosed and described in commonly assigned U.S. Pat. No. 4,788,519, the disclosure of which is hereby expressly incorporated herein by reference.

While designed for repeated use, an exhaust control device has a finite useful life after which it must be replaced. Use of an exhaust control device after it has reached its useful life may result in the dangerous discharge of hot arc products and gases. However, it can be difficult to know whether the device has reached the end of its useful life. A manufacturer may specify criteria that define a condition or conditions of one or more components of the device indicative of the end of its useful life. For example, should a baffle of the device be ruptured or eroded beyond a specified condition the exhaust control device is deemed to be beyond its useful life. However, it may be difficult to determine the condition of the one or more component, and moreover, determining the condition requires periodic inspection by trained personnel.

DETAILED DESCRIPTION

A wear indicator for an exhaust control device is mountable to the exhaust control device. The wear indicator has at least one structural feature that changes from a first observable state corresponding to the exhaust control device having remaining useful life to a second observable state corresponding to the exhaust control device having reached the end of its useful life and needing replacement. The wear indicator may be a ring, a bridge, one or more pins, a multi-layer structure, a string of beads or other suitable structural member secured to or formed with a baffle of the exhaust control device. The wear indicator is exposed to the flow of exhaust gases through the exhaust control device during operation of the exhaust control device with this exposure causing the change from the first state to the second state.

Figure 1:
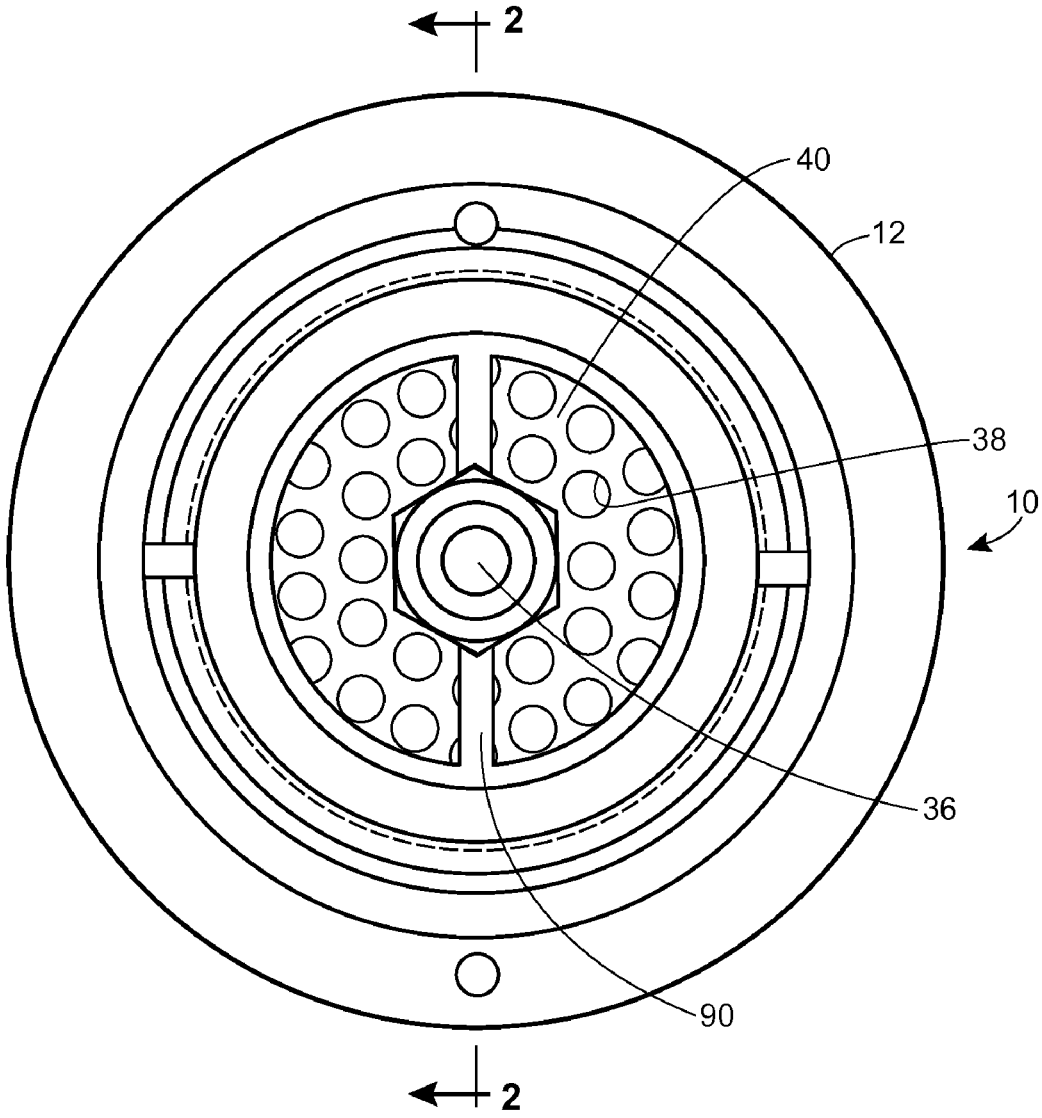
FIG. 1 is an end elevation view of an exhaust control device incorporating a wear indicator in accordance with a first embodiment of the invention.
Figure 2:
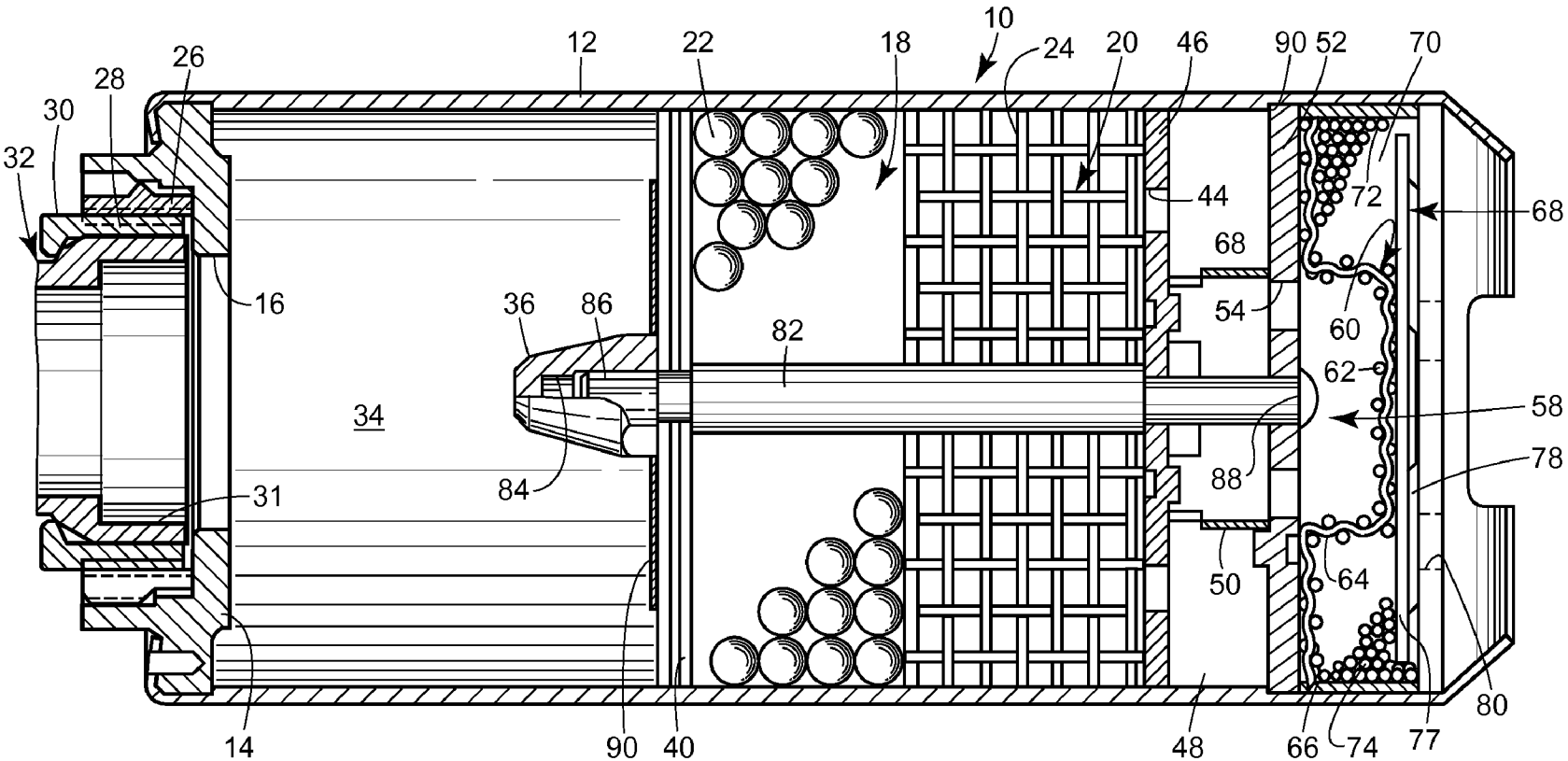
FIG. 2 is a sectional view taken along line 2-2 of FIG. 1.

Referring to FIGS. 1 and 2, a wear indicator 90 may be used in conjunction with an exhaust-control device 10, such as that shown in the aforementioned U.S. Pat. No. 4,778,519. The particular structure of the exhaust control device is not critical to the inventive aspects of the wear indicator. Nonetheless, to assist in the understanding of the structure and function of a wear indicator in accordance with the present invention it is described in the context of an exhaust control device, such as the exhaust control device 10.

The exhaust control device 10 may include a housing 12. The housing 12 includes an end wall 14 that defines an intake port 16. The exhaust-control device 10 may include a plurality of sections or layers of heat-absorbing medium or materials. Two sections, a first section 18 and a second section 20, are illustrated. The sections 18 and 20 can also be referred to as heat sinks. Hot exhaust gases entering the intake port 16 pass through the first section 18 and thereafter pass through the second section 20. The temperature of the exhaust gases is reduced by passage through the first section 18 and is further reduced by passage through the second section 20. Selection of the material and configuration of the selected materials to provide the layers of heat-absorbing medium is not within the scope of the instant invention, and any suitable materials having any suitable configuration may be used.

The end wall 14 includes provisions, e.g., threads 26, for engagement with threads 28 of a locking collar 30 which is affixed to a circuit interrupter, such as a fuse 32. When the fuse 32 operates, energy is produced in the form of heat, light, and sound with hot exhaust gases (i.e., arc products) being expelled through a hollow exhaust extension 31 of the fuse 32. The quantity of energy produced by the operation of the fuse 32 varies with the circuit voltage, the magnitude of current being interrupted, and the point of the alternating-current wave at which the fault is initiated; e.g., overcurrent resulting from a fault condition. If the fuse 32 utilizes a fusible metallic element, arcing rod, etc., the exhaust gases will contain metallic vapors.

The hot exhaust gases exiting the exhaust extension 30 and passing through the intake port 16 are initially received in a gas expansion chamber 34. The arc produced during the operation of the fuse 32 may be blown into the exhaust-control device 10 by the inrush of exhaust gases, and this arc tends to settle on a conductive arcing tip 36 that is provided for this purpose and disposed within the gas expansion chamber 34 and along the center of the exhaust-control device 10. The exhaust gases then pass through the openings 38 of an upper baffle plate 40 and into the first section 18 of heat-absorbing material. The heat-absorbing material 22 absorbs substantial energy from the exhaust gases, resulting in a substantial drop in the temperature of the exhaust gases exiting the first section 18 and passing into the second section 20. The exhaust gases leave the first section 18 and enter the second section 20 encountering another heat-absorbing medium, e.g., woven copper mesh 24. The exhaust gases then pass through the second section 20 being further cooled.

The exhaust gases, after passing through the second section 20, pass through holes 44 of a diverter plate 46. After passing through the diverter plate 46, the exhaust gases enter a middle chamber 48. The middle chamber 48 is defined by the housing 12, the diverter plate 46, a spacer 50, and a middle baffle plate 52. The exhaust gases pass through the middle chamber 48 through the holes 54 of a middle baffle plate 52 and into a lower chamber 58. The lower chamber 58 is defined by the middle baffle plate 52, a screen member 60, and the housing 12. The screen member 60 may include a bottom wall 62, a circumferential side wall 64, and a rim 66. The rim 66 is positioned against the middle baffle plate 52 and the bottom wall 62 is positioned against a lower baffle assembly 68. A volume 70, between the screen member 60 and a sleeve 72 adjacent the housing 12, may include a heat-absorbent material. A lower baffle assembly 68 may include a front baffle member 77 with slots 76 and a baffle member 78 with holes 80. The exhaust gases passing through the lower chamber 58 pass through volume 70 and then through the front baffle 77 and the holes 80 of the baffle member 78. The holes 80 function as exhaust ports. The exhaust gases then pass out to the environment of the exhaust-control device 10 and the fuse 32.

As illustrated in FIGS. 1-2, the baffle member 40 may include a wear indicator 90 mounted thereon. The wear indicator 90 is easily viewable via the port 16 of the end wall 14. Visually inspecting the condition of the wear indictor 90 to determine its state provides a simple, reliable method of determining whether the exhaust control device 10 has remaining useful life.

The wear indicator 90 is designed to be fitted to existing baffles, such as the baffle 40, without modification of the baffle 40. In alternate embodiments of the invention, however, modification of the baffle 40 accommodates incorporation or integration of the wear indicator 90 (e.g., the embodiment illustrated in FIG. 7).

Figure 3:
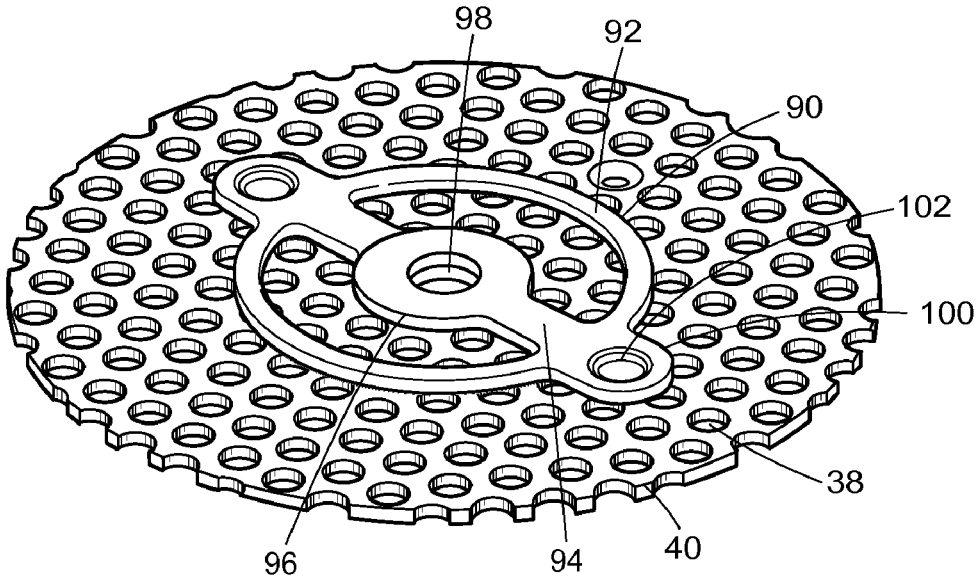
FIG. 3 is a perspective view of a baffle of an exhaust control device, such as that illustrated in FIG. 1, including a wear indicator.
Figure 4:
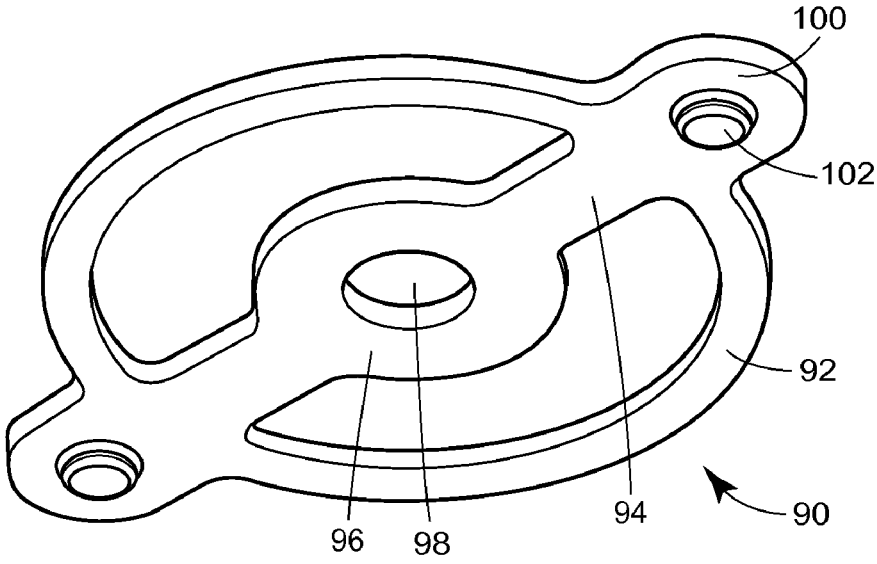
FIG. 4 is a perspective view of the wear indicator shown in FIG. 3.

Referring to FIGS. 3 and 4, the wear indicator 90 includes a ring member 92 having an outside diameter (OD), an inside diameter (ID) and a ring width. The thickness of the wear indicator 90 may be selected to be substantially the same as the thickness of the baffle 40. When the baffle 40 is a multi-layer structure, as shown in FIG. 2, the ring member may have a thickness from about approximately that of a single layer of the multi-layer structure to about the total of the multi-layer structure. The OD, ID and ring width are selected so that the ring fractures, i.e., assumes the second visually observable state, corresponding to the associated exhaust control device reaching the end of its useful life. In one example, the OD may be made slightly larger than the inner diameter (ID) of the port 16, for example, from about 35 mm to about 42 mm (about 1.4 inch to about 1.7 inch). The ID may be from about 32 mm to about 35 mm (about 1.25 inch to about 1.5 inch) resulting in a ring width of approximately 2-2.5 mm (approximately 3/32 inch). Thus, the easily viewed and determined rupture, fracture or discontinuity of the ring member 92, the second visually observable state, is an indication that the exhaust control device 10 has reached the end of its useful life and should be replaced.

To position and secure the wear indicator 90 relative to the baffle 40, a strap member 94 may be formed with the ring member 92. The strap member 94 includes a hub portion 96 formed with an aperture 98. The aperture 98 is received over a stud 82 that includes a threaded end 84 that threads into a threaded passage 86 of the arcing tip 36 holding the wear indicator 90 in place relative to the baffle 40. The wear indicator 90 may further and optionally be formed with ear portions 100 formed with dimples 102. The ear portions formed with dimples 102 allow the wear indicator 90 to be positioned relative to the baffle 40 with engagement of the dimples with the apertures 38 preventing rotation of the wear indicator 90 upon tightening of the arcing tip.

The wear indicator 90 may be formed from metal, and for example, the same metal used to form the baffle 40. Additionally, the wear indicator 90 may be painted or otherwise coated to distinguish it from the baffle 40. While the paint or coating may not survive the initial few operations of the exhaust control device, the coating does provide at least initially a very easily observable indication of the useful life of the exhaust control device.

Figure 5:
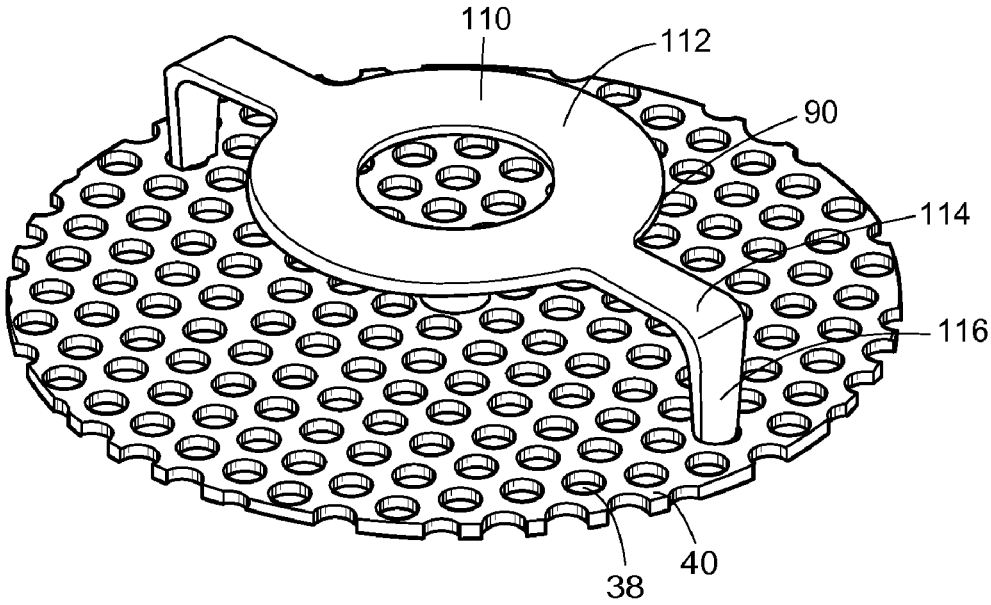
FIG. 5 is a perspective view of a baffle of an exhaust control device incorporating a wear indicator in accordance with another embodiment of the invention.

FIG. 5 illustrates an alternate embodiment of a wear indicator. The wear indicator 110 includes a ring member 112. The ring member 112 may have construction and dimensions similar to those described above in connection with the ring member 92. Legs 114 formed with the ring member 112 extend radially outwardly from the ring member 112. The legs 114 are "L" shaped, and an end 116 of each leg 114 extends through apertures 38 of the baffle member 40. A spring-like action of the legs 114 holds the wear indicator 110 in place relative to the baffle 40. The legs 114 support the ring member 112 away from the baffle 40 in spaced relationship. For example, the ring member 112 may be supported between about 6 to about 13 mm (approximately 0.25 inch to about 0.50 inch). Similar to the wear indicator 90 and ring member 92, rupture or fracture of the ring member 112 provides an indication that the exhaust control device 10 has reached the end of its useful life.

Figure 6:
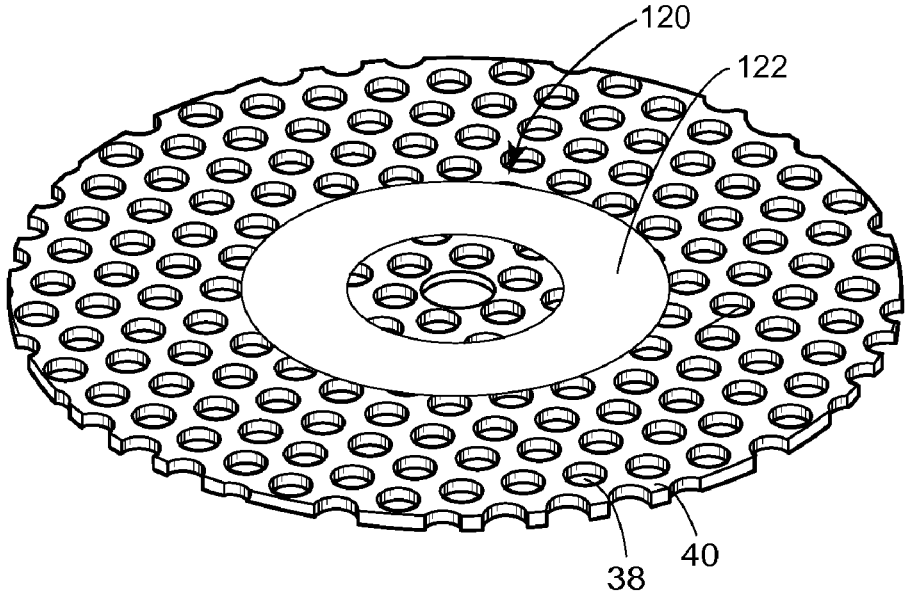
FIG. 6 is a perspective view of a baffle of an exhaust control device incorporating a wear indicator in accordance with another embodiment of the invention.

FIG. 6 illustrates a further alternate embodiment of a wear indicator. The wear indicator 120 includes a ring member 122 formed integral with the baffle 40. In this case, the ring member 122 is made of the same material as the baffle 40. The ring member 122 may be dimensionally specified substantially as described above in connection with the ring member 92, and, for example, the OD may be from about 30 mm to about 40 mm (about 1.2 inch to about 1.5 inch and the ID may be from about 18 mm to about 26 mm (about 0.70 inch to about 1.0 inch). Similar to the wear indicator 90 and the ring member 92, rupture or failure of the ring member 122 provides an indication that the exhaust control device 10 has reached the end of its useful life. The baffle 40 may be a multi-layer structure, as shown in FIG. 2. When the baffle 40 has a multi-layer structure, the ring member 122 may be formed in one or more of the multiple layers. For example, the ring member 122 may be formed in an upper most layer that is easily viewable through the port 16.

Figure 7:
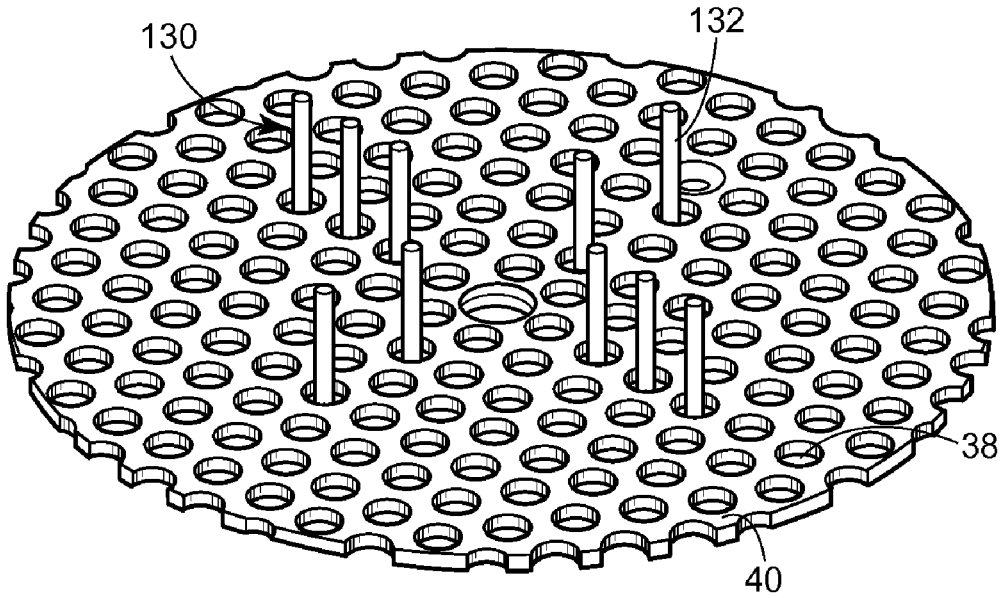
FIG. 7 is a perspective view of a baffle of an exhaust control device incorporating a wear indicator in accordance with another embodiment of the invention.

FIG. 7 illustrates a still further alternate embodiment of a wear indicator. The wear indicator 130 includes a plurality of pins 132 that extend through the apertures 38 substantially normally to the baffle 40. The pins 132 may extend above the surface of the baffle 40 by between about 6 to about 13 mm (0.25 inch to about 0.5 inch). The pins 132 may be secured to a base (not depicted) that is positioned against an opposite surface from the surface through which the pins 132 extend. In an embodiment where the baffle 40 is a multi-layer structure (as shown in FIG. 2) the base may be positioned between layers of the multi-layer baffle 40 to secure the wear indicator in place relative to the baffle 40. The pins 132 wear away with use of the exhaust control device. When the pins 132 are no longer observable, it is an indication that the exhaust control device 10 has reached the end of its useful life.

As noted, the baffle 40 may be a multi-layer structure. In this regard, a wear indicator may be provided integrally formed with the baffle 40 by painting or coating alternate layers of the multiple layers forming the baffle 40 in different colors. For example, the outer most layer may be coated in a green color, a middle layer in a yellow color and a bottom or last layer of wear before failure, in a red color. Observation of the color of the wear indicator provides a visual indication that the exhaust control device 10 has remaining useful life.

Figure 8:
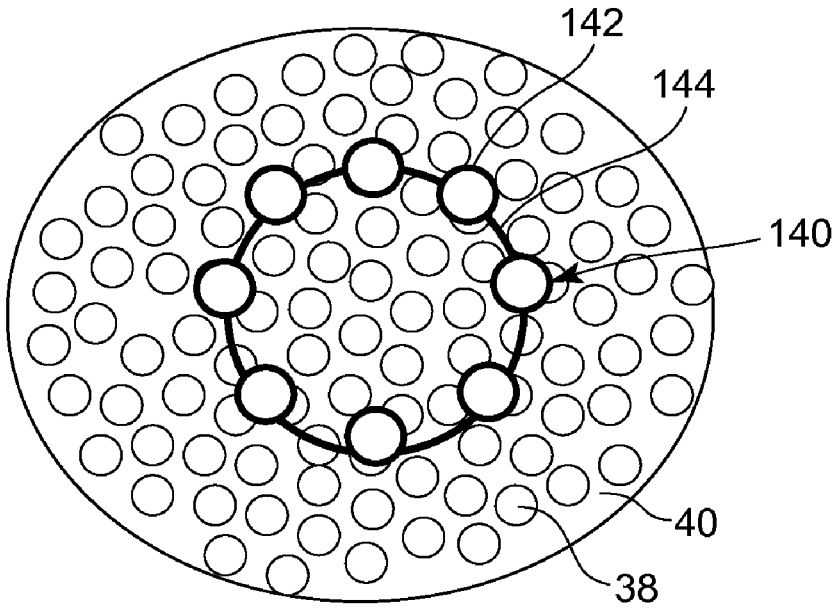
FIG. 8 is a plan view of a baffle of an exhaust control device incorporating a wear indicator in accordance with another embodiment of the invention.

FIG. 8 illustrates a still further alternate embodiment of a wear indicator. The wear indicator 140 includes a plurality of "beads" 142 that are secured on a ring, or "string" 144. The ring 144 may be a thin section of material, such as a metal similar to that used to make the baffle 40, and may have a circular cross-section, a single or multiple strand wire or the like. The beads 142 may be made of metal, ceramic or other suitable generally heat resistant material and may be formed directly on the "string", or with apertures through which the ring 144 is loosely disposed. The beads 142 may be formed from, coated or otherwise made to have a brightly colored appears so as to be easily observed. Observation of the ring 144 and beads 142 provides a visual indication of remaining useful life. When the exhaust control device 10 has reached the end of its useful life, the ring 144 fractures releasing the beads. Shaking of the exhaust control device 10 results in a rattling sound and visual observation will show the beads to have separated from the "string", thus providing two verifiable indications that the exhaust control device has reached the end of its useful life.

The invention has been described in terms of several preferred embodiments. One of skill in the art will appreciate that the invention may be otherwise embodied without departing from its fair scope, which is set forth in the subjoined claims.

We claim:

1. An exhaust control device comprising:

a wear indicator to be arranged within a housing of the exhaust control device and to be exposed to a flow of exhaust gas through the exhaust control device, the wear indicator having a first observable state indicative of remaining useful life of the exhaust control device and being responsive to a flow of exhaust gas through the exhaust control device to assume a second observable state indicative of the exhaust control device having reached the end of its useful life, wherein the wear indicator comprises a plurality of "beads" secured relative to a surface of a baffle member of the exhaust control device, and wherein the second observable state is the beads being free to move relative to the baffle and to each other to cause a rattling sound upon shaking of the exhaust control device.

2. The exhaust control device of claim 1, wherein the beads in the first observable state are secured to a ring member supported adjacent a baffle member of the exhaust control device and are not free to move relative to the baffle and to each other to cause an discernable audible indication.

3. The exhaust control device of claim 2, wherein the ring member is secured to a surface of a baffle member.

4. The exhaust control device of claim 1, wherein the first observable state further comprises a first color indication of the beads and the second observable state further comprise a second color indication of the beads, different than the first color indication.

5. The exhaust control device of claim 1, wherein the wear indicator has more than one first observable state and more than one second observable state.

* * * * *